US007405714B2

(12) United States Patent
Shih

(10) Patent No.: US 7,405,714 B2
(45) Date of Patent: Jul. 29, 2008

(54) PIXEL DRIVING CIRCUIT AND PIXEL DRIVING METHOD

(75) Inventor: Li-Wei Shih, Minsyong Township, Chiayi County (TW)

(73) Assignee: AU Optronics Corp., Hsinchu (TW)

( * ) Notice: Subject to any disclaimer, the term of this patent is extended or adjusted under 35 U.S.C. 154(b) by 597 days.

(21) Appl. No.: 11/108,197

(22) Filed: Apr. 18, 2005

(65) Prior Publication Data

US 2006/0125412 A1 Jun. 15, 2006

(30) Foreign Application Priority Data

Dec. 13, 2004 (TW) ..... 93138574 A

(51) Int. Cl.
*G09G 3/32* (2006.01)
*G09G 5/00* (2006.01)
*G06F 3/038* (2006.01)

(52) U.S. Cl. ..... 345/82; 345/204; 315/169.3

(58) Field of Classification Search ..... 345/204, 345/76, 82; 315/169.1, 169.3
See application file for complete search history.

(56) References Cited

U.S. PATENT DOCUMENTS 6,873,116 B2 * 3/2005 Kimura et al. ..... 315/169.1
7,173,585 B2 * 2/2007 Weng ..... 345/82
7,193,588 B2 * 3/2007 Lo ..... 345/76

FOREIGN PATENT DOCUMENTS

CN 1532788 9/2004
CN 1540615 10/2004

OTHER PUBLICATIONS

CN Office Action mailed Mar. 2, 2007.

* cited by examiner

*Primary Examiner*—Amr Awad
*Assistant Examiner*—Stephen G Sherman
(74) *Attorney, Agent, or Firm*—Thomas, Kayden, Horstemeyer & Risley

(57) ABSTRACT

A pixel driving circuit for use in an Active Matrix Organic Light Emission Display (AMOLED). A pixel driving method for use in the AMOLED. The pixel driving circuit comprises a current source, a driving pump, and a discharge circuit. A fixed current is provided by the current source. The driving pump coupled to the current source and a Light Emitting Diode (LED), charges a cell to saturation by the fixed current, such that the potential of the cell drives the LED lighting. The discharge circuit, coupled to the driving pump and a data line, controls the cell discharge based on a data signal on the data line. The discharge circuit controls the cell discharge speed, whereby the LED lighting time and luminance is adjusted.

15 Claims, 4 Drawing Sheets

PIXEL DRIVING CIRCUIT AND PIXEL DRIVING METHOD

BACKGROUND

The invention relates to Active Matrix Organic Light Emission Display (AMOLED), and in particular, to a pixel driving circuit and method for use in the AMOLED.

One Organic Light Emitting Diode (OLED) type is AMOLED, generally utilized for flat panel display. One conventional AMOLED driving technique is voltage driven, in which the data signal is transformed to a current by a Thin Film Transistor (TFT) on the glass substrate, and the AMOLED is driven light by the current with brightness corresponding to the magnitude thereof. The threshold voltages of TFTs can vary, however, due to fabrication errors or operating temperature difference, thus causing inequality when displaying an image. Another technique, current driven, uses a data current memorized by the TFT, whereby the AMOLED is driven to emit corresponding luminance within one frame. Current driving ICs are costly, however, and suffer from inaccuracy due to parasitic capacitor effect when low data current is fed. Therefore a breakthrough is desirable for both driving techniques.

SUMMARY

An embodiment provides a pixel driving circuit for use in an Active Matrix Organic Light Emission Display (AMOLED) comprising a current source, a driving pump, and a discharge circuit. A fixed current is provided by the current source. The driving pump coupled to the current source and a Light Emitting Diode (LED) charges a cell to saturation by the fixed current, such that the potential of the cell drives the LED lighting. The discharge circuit coupled to the driving pump and a data line controls the cell discharge based on a data signal on the data line. The discharge circuit controls the cell discharge speed, whereby the LED lighting time and luminance is adjusted.

The driving pump is coupled to a scan line. In response to a first signal from the scan line, the driving pump charges the cell to saturation by the fixed current. The discharge circuit is coupled to the scan line. In response to a second signal from the scan line, the potential of the cell drives the LED lighting, and simultaneously, the discharge circuit discharges the cell of a speed corresponding to the data signal.

In response to the first signal, the discharge circuit generates a speed control potential based on the data signal. In response to the second signal, the discharge circuit discharges the cell of a speed controlled by the speed control potential. The LED is an Active Matrix Organic Light Emitting Diode (AMOLED)

Another embodiment provides a pixel driving method for use in an Active Matrix Organic Light Emission Display (AMOLED). A data signal is provided. In response to a first signal, a fixed current is provided to charge a cell to saturation. In response to a second signal, a LED is driven lighting by the potential of the cell, and simultaneously, the cell is discharged of a speed corresponding to the data signal. The data signal affects the cell discharge speed, thereby the LED lighting time and luminance is adjusted.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION

An embodiment provides a fixed current that charges a cell to saturation, the potential of which drives the LED light. A data signal is provided in voltage form to control the discharge speed of the cell, whereby the emitting time and brightness of the LED can be adjusted.

Figure 1:
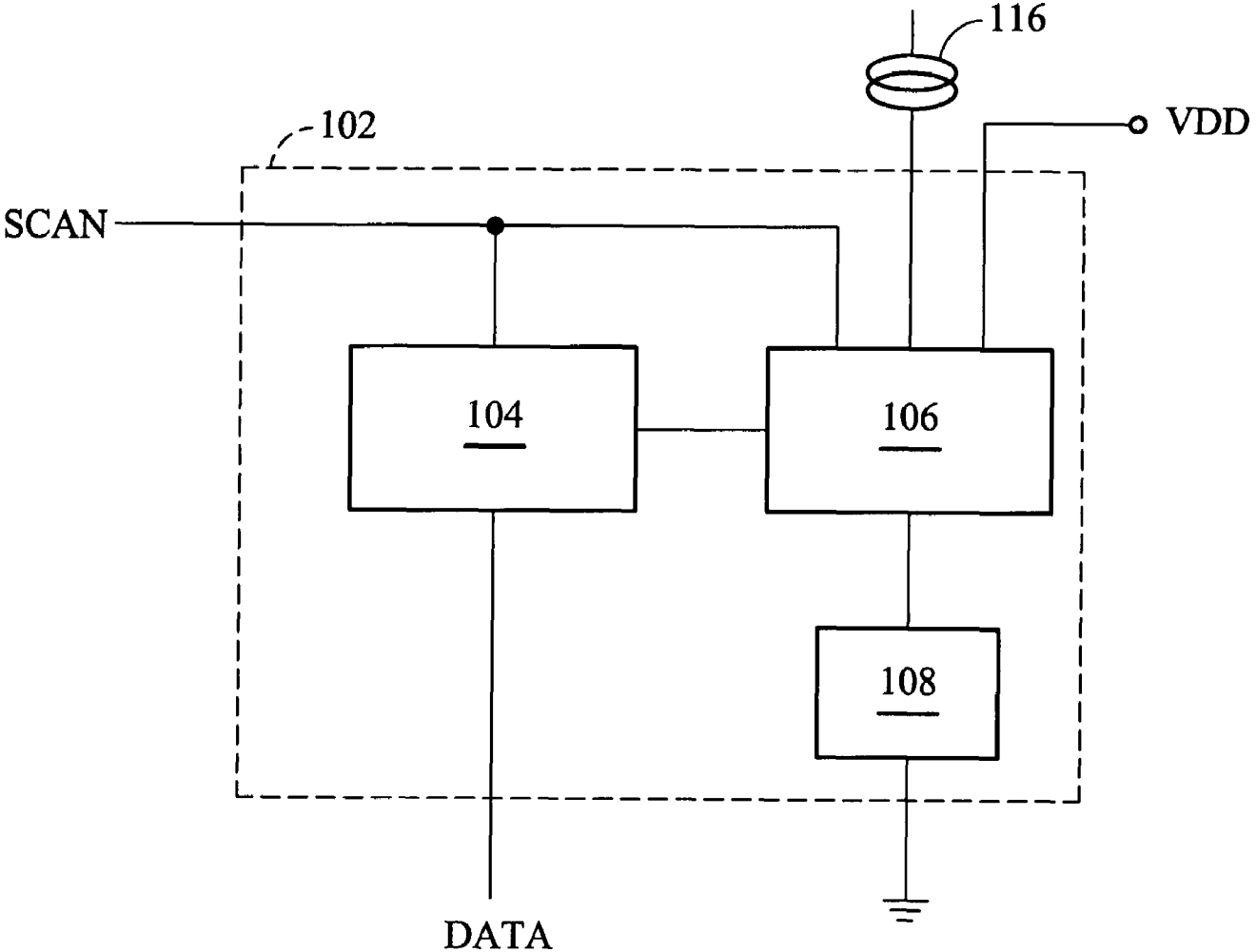
FIG. 1 shows an embodiment of the pixel driving diagram.

FIG. 1 shows an embodiment of the pixel driving diagram. The pixel driving circuit 102 comprises a discharge circuit 104, a driving pump 106 and a LED 108. The discharge circuit 104 is coupled to a scan line 118 and a data line 120. The driving pump 106 is coupled to the discharge circuit 104, the scan line 118 and a current source 116. The LED 108 is coupled to the driving pump 106. When the scan line 118 is in ON state, the discharge circuit 104 is activated to read a data signal applied to the data line 120. Simultaneously, the driving pump 106 charges the cell by current $I_0$ provided from the current source 116 until saturation. When the scan line 118 is in OFF state, the cell in the driving pump 106 drives the LED 108 light with the saturation potential charged, and simultaneously, the cell is discharged by the discharge circuit 104 at a speed based on the data signal received on the data line 120. In this way, the brightness of LED 108 is dynamically decreased along with the reduced potential of the cell, and the equivalent visual effect in one frame can be determined by integration of the total luminance emitted. Gray levels are therefore achieved.

Figure 2:
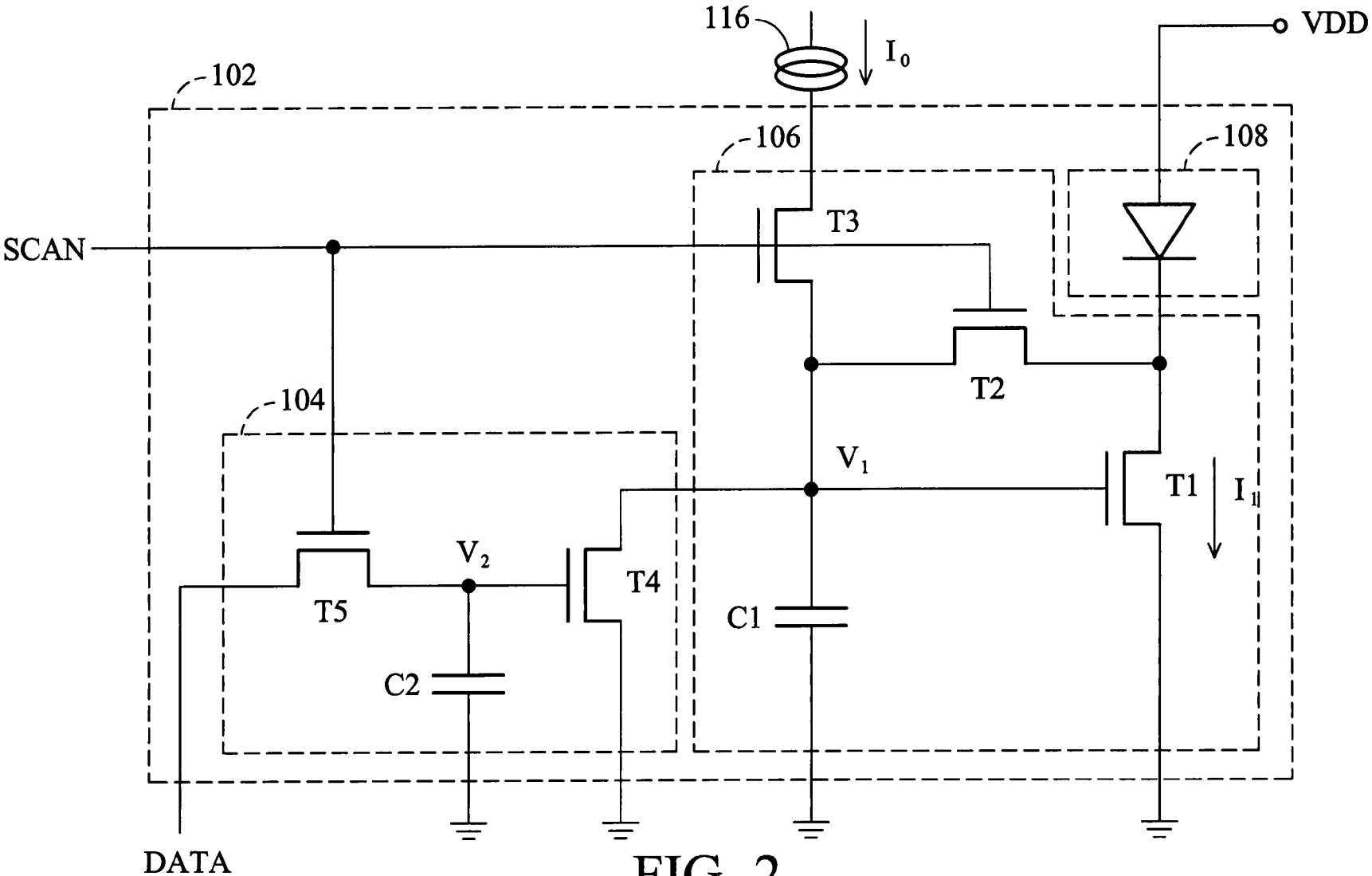
FIG. 2 shows an embodiment of the pixel driving circuit.

FIG. 2 shows an embodiment of the pixel driving circuit. The operation of pixel driving circuit 102 comprising the discharge circuit 104, driving pump 106 and LED 108, is based on the diagram in FIG. 1. Specifically, the driving pump 106 comprises transistor T1, transistor T2, transistor T3 and capacitor C1, and the discharge circuit 104 comprises transistor T4, transistor T5 and capacitor C2. The transistor T2 and transistor T3 function as switches, and the transistor T1 provides current to the LED 108. When the scan line 118 is in ON state, transistor T2 and transistor T3 in the driving pump 106 are activated, and the current $I_0$ is fed from the current source 116 to the driving pump 106 to charge the capacitor C1. Simultaneously, the scan line 118 activates the transistor T5, whereby the potential of the data signal is stored in capacitor C2. Shortly after the capacitor C1 and capacitor C2 complete charging, the node $V_1$ and $V_2$ have corresponding potentials. Thereafter, when the scan line 118 switches to OFF state, the transistor T2 and transistor T3 are closed, the potential on node $V_1$ activates the transistor T1 and generates a current $I_1$, driving the LED 108 to light. Simultaneously, the transistor T5 is closed, and the potential on $V_2$, relative to the data signal, activates the transistor T4, such that a current flows from node $V_1$ to the drain of the transistor T4, gradually pulling the potential on node $V_1$ low. The current $I_1$, driven based on the potential of node $V_1$, is pulled down accordingly. As a result, the brightness of the LED 108 also decreases. In other words' the data signal determines the decreasing speed of brightness on LED 108.

Figure 3:
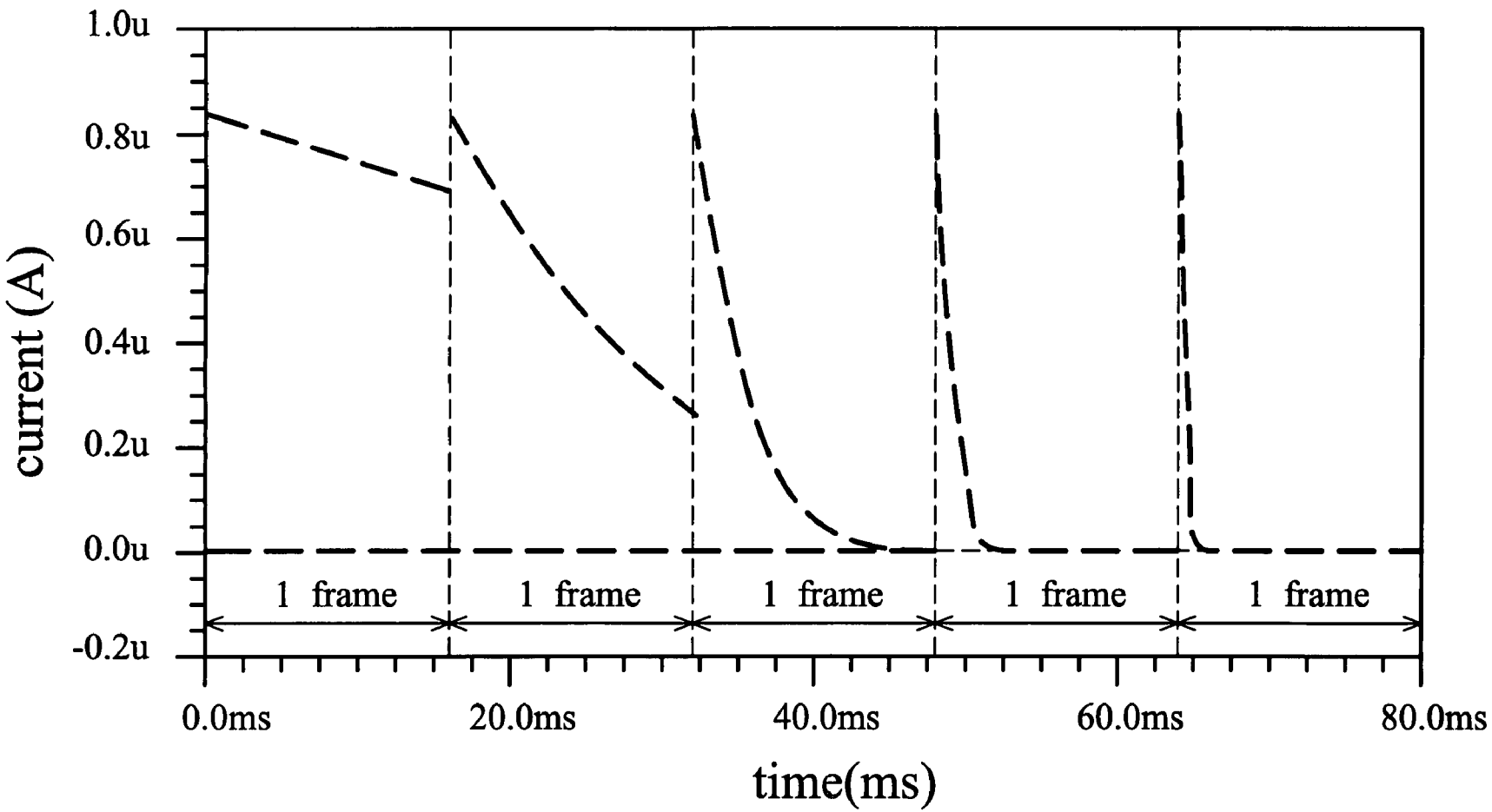
FIG. 3 is a current chart according to the embodiment in FIG. 2.

FIG. 3 is a current chart according to the embodiment in FIG. 2. Five frames are shown, each having a duration of 16 ms. For each frame, the current is purposely pulled to a saturation level at the beginning, and decreases at varied speed to generate gray level variations. Conventionally, the relationships between the data signal, the decreasing speed, and the gray levels, are not linear, therefore a lookup table such as gamma correction can be defined to accomplish the implementation. Gamma correction is known to the art, thus detailed examples are omitted herein.

Figure 4:
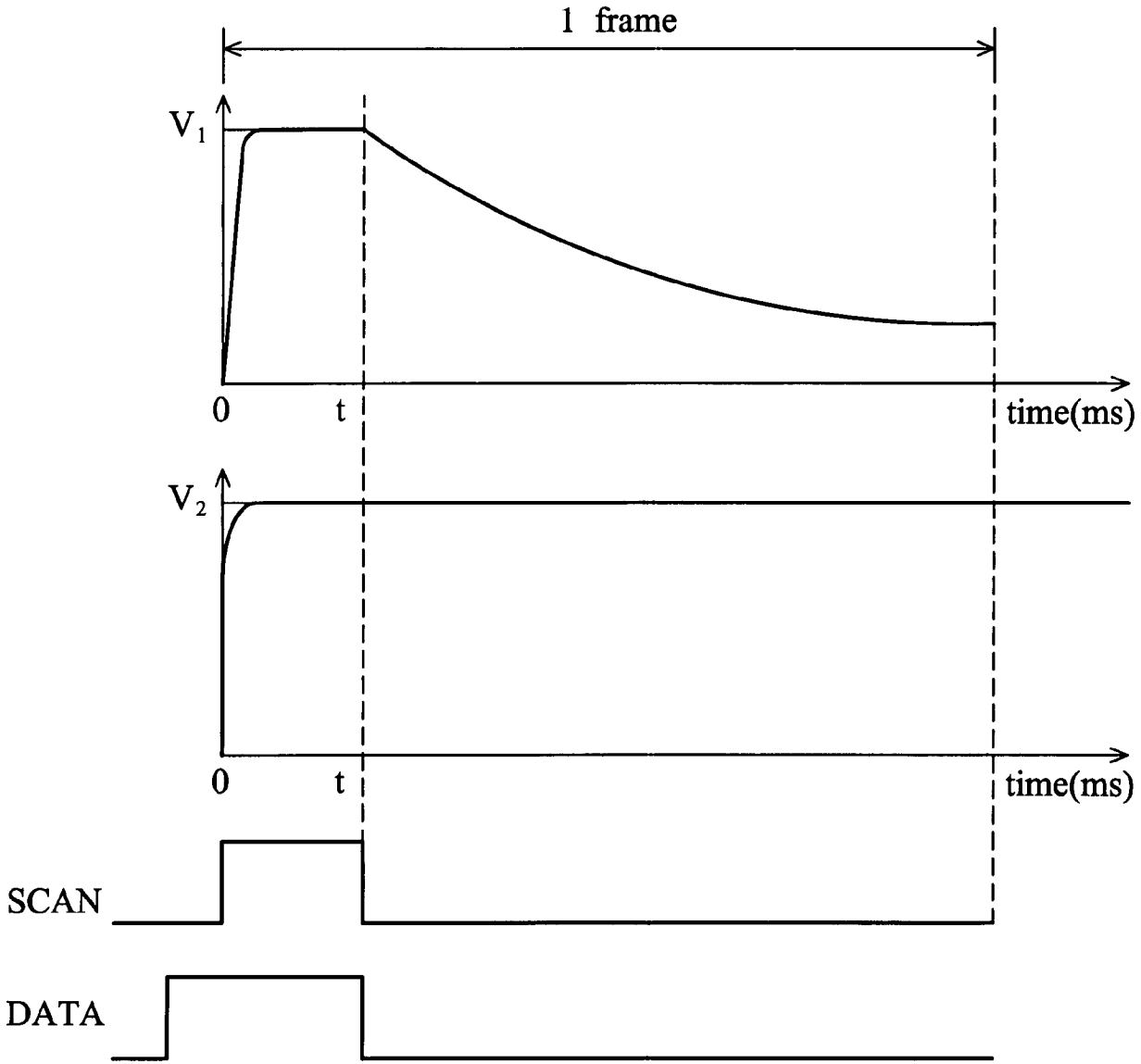
FIG. 4 is a voltage chart within one frame according to the embodiment in FIG. 3.

FIG. 4 is a voltage chart within one frame according to the embodiment in FIG. 3. When the scan line 118 is in ON state, the potentials on node $V_1$ and $V_2$ start to change. The potential of $V_1$ is pulled to a predetermined saturation level, and the potential on node $V_2$ is pulled to the potential of the data signal. At time t, the scan line 118 switches to OFF state, the transistor T4 in FIG. 2 is then activated to discharge the potential on the node $V_1$, and the current on the transistor $T_1$ is decreasing accordingly. The transistor $T_1$ can be a NMOS, so the potential of node $V_1$ and the current $I_1$ can be described in the formula:

$$I_1K(V_1-V_{th})^2$$

where K is a coefficient constant of the transistor T1, and $V_{th}$ is the threshold voltage of the transistor T1.

In summary, the embodiment described overcomes the difficulty of the conventional current driven method by providing a fixed current, and additionally, the bottlenecks of inequality in the conventional voltage driven method are eliminated by controlling the discharge speed based on the data signal.

While the invention has been described by way of example and in terms of the preferred embodiment, it is to be understood that the invention is not limited thereto. To the contrary, it is intended to cover various modifications and similar arrangements (as would be apparent to those skilled in the art) Therefore, the scope of the appended claims should be accorded the broadest interpretation so as to encompass all such modifications and similar arrangements.

What is claimed is:

1. A pixel driving circuit for an active matrix organic light emission display (AMOLED) having a plurality of organic light emitting diodes (OLEDs), each controlled by a data line and a scan line, comprising:

a current source;

a driving pump, coupled to the current source and one of the plurality of OLEDs, for charging a cell to saturation by the current source; and a discharge circuit, coupled to the driving pump and the data line, for controlling the cell discharge speed based on a data signal from the data line, whereby the OLED lighting time and luminance is adjusted; wherein:

the discharge circuit is coupled to the scan line; and in response to a second signal from the scan line, the potential of the cell drives the OLED lighting, and simultaneously, the discharge circuit discharges the cell at a speed corresponding to the data signal.

2. The pixel driving circuit of claim 1, wherein:

the driving pump is coupled to the scan line; and in response to a first signal from the scan line, the driving pump charges the cell to saturation by the current source.

3. The pixel driving circuit of claim 1, wherein in response to the first signal, the discharge circuit is configured to generate a speed control potential based on the data signal.

4. The pixel driving circuit of claim 3, wherein in response to the second signal, the discharge circuit is configured to discharge the cell at a speed controlled by the speed control potential.

5. The pixel driving circuit of claim 1, wherein the driving pump comprises:

a first transistor comprising a source coupled to the source of the second transistor, a gate coupled to a first node, and a drain grounded;

a second transistor comprising a gate coupled to the scan line, a drain coupled to the first node;

a third transistor comprising a source coupled to the current source, a drain directly connected to the first node, and a gate coupled to the scan line; and a first capacitor comprising one end coupled to the first node and the other end grounded.

6. The pixel driving circuit of claim 5, wherein the discharge circuit comprises:

a fourth transistor comprising a source coupled to the first node, a gate coupled to a second node, and a drain grounded;

a fifth transistor comprising a source coupled to the second node, a drain coupled to a data line, and a gate coupled to the scan line; and a second capacitor comprising one end coupled to the second node and the other node grounded.

7. The pixel driving circuit of claim 6, further comprising an OLED comprising one end coupled to a power supply, and the other end coupled to the sources of the first and the second transistors.

8. The pixel driving circuit of claim 7, wherein, in response to a first signal from the scan line, the second transistor and the third transistor are activated, and the first capacitor is charged to saturation by the current source.

9. The pixel driving circuit of claim 8, wherein in response to a second signal from the scan line, the second and third transistors are off, and potential of the first capacitor activates the first transistor and drives the OLED lighting, and simultaneously, the capacitor is discharged by the discharge circuit at a speed corresponding to the potential of the data line.

10. The pixel driving circuit of claim 9, wherein in response to the first signal, the fifth transistor is activated, and the second capacitor stores the potential of the data line.

11. The pixel driving circuit of claim 10, wherein in response to the second signal, the fifth transistor is off, and the fourth transistor is driven by the potential stored in the second capacitor to discharge the first capacitor.

12. The pixel driving circuit of claim 1, wherein the OLED is an active matrix organic light emitting diode (AMOLED).

13. A pixel driving method for an active matrix organic light emission display (AMOLED) having an organic light emitting diode (OLED), comprising:

providing a data signal;

providing, in response to a first signal, a fixed current to charge a cell to saturation;

driving, in response to a second signal, the OLED lighting by the potential of the cell simultaneously when discharging the cell, into a discharge circuit, at a speed corresponding to the data signal;

wherein the data signal is adapted to control the cell discharge speed, thereby adjusting the OLED lighting time and luminance.

14. The method of claim 13, further comprising generating, in response to the first signal, a speed control potential based on the data signal.

15. The method of claim 14, wherein the speed for discharging is controlled by the speed control potential.

* * * * *